US009797090B2

(12) United States Patent
Long et al.

(10) Patent No.: US 9,797,090 B2
(45) Date of Patent: Oct. 24, 2017

(54) PHOTOCATALYTIC METHOD OF DISCHARGE PRINTING FOR PRODUCING COLORFUL PATTERNS ON PREVIOUSLY DYED TEXTILES

(71) Applicant: Soochow University, Suzhou, Jiangsu Province (CN)

(72) Inventors: Jiajie Long, Suzhou (CN); Xiaoping Bi, Suzhou (CN)

(73) Assignee: Soochow University, Suzhou (CN)

( * ) Notice: Subject to any disclaimer, the term of this patent is extended or adjusted under 35 U.S.C. 154(b) by 0 days.

(21) Appl. No.: 14/758,775

(22) PCT Filed: Apr. 2, 2013

(86) PCT No.: PCT/CN2013/073615

§ 371 (c)(1),
(2) Date: Jun. 30, 2015

(87) PCT Pub. No.: WO2014/121552

PCT Pub. Date: Aug. 14, 2014

(65) Prior Publication Data

US 2015/0354135 A1 Dec. 10, 2015

(30) Foreign Application Priority Data

Feb. 8, 2013 (CN) ..... 2013 1 0050296

(51) Int. Cl.
*D06P 5/15* (2006.01)
*D06P 5/20* (2006.01)

(52) U.S. Cl.
CPC ..... *D06P 5/2005* (2013.01); *D06P 5/15* (2013.01); *D06P 5/153* (2013.01); *D06P 5/155* (2013.01); *D06P 5/158* (2013.01)

(58) Field of Classification Search
CPC ..... D06P 5/2005; D06P 5/153; D06P 5/15; D06P 5/158; D06P 1/38; D06P 3/66
See application file for complete search history.

(56) References Cited

U.S. PATENT DOCUMENTS 1,926,086 A * 9/1933 Dreyfus ..... D06P 5/15 8/458
2,531,886 A * 11/1950 Mills ..... B41L 45/00 101/48
3,679,348 A * 7/1972 Asahi ..... D06M 13/127 8/115.7

FOREIGN PATENT DOCUMENTS

| | | | |
|---|---|---|---|
| CN | 101787644 | * | 7/2010 |
| CN | 101787644 A | | 7/2010 |
| JP | H04174784 A | | 6/1992 |
| JP | H06207386 A | | 7/1994 |
| JP | 409013287 | * | 1/1997 |

* cited by examiner

*Primary Examiner* — Amina Khan
(74) *Attorney, Agent, or Firm* — SZDC Law P.C.

(57) ABSTRACT

A photocatalytic method of colored discharge printing for producing colorized patterns on textiles includes over dyeing textiles with illuminant dyes and ground shade dyes respectively, manufacturing patterned printing plates with hollow-out decorative patterns, applying a photocatalyst on the over-dyed textiles through the hollow-outs, using a photocatalytic method of colored discharge printing to produce localized discoloration of the ground shade while leaving the illuminant dyes on the textile which produces an effect of colorized patterns on the textiles. The method has the characteristics of being a simple process with a simple apparatus and has short processing, easy control and wide adaptability. The method eliminates the needs for printing pastes and expensive printing apparatus used in the complicated process in a conventional printing method.

9 Claims, 4 Drawing Sheets

PHOTOCATALYTIC METHOD OF DISCHARGE PRINTING FOR PRODUCING COLORFUL PATTERNS ON PREVIOUSLY DYED TEXTILES

This application is a National Stage Application of International Application No. PCT/CN2013/073615, filed on Apr. 2, 2013, which claims the benefit of Chinese Application No. 201310050296.3, filed on Feb. 8, 2013, all of which are hereby incorporated by reference in their entirety for all purposes as if fully set forth herein.

FIELD

The present invention relates to a technology of textile dyeing and finishing. Particularly, it relates to a photocatalytic method of colored discharge printing for producing colorized patterns on textiles over-dyed. It produces colorized patterns on over-dyeing textiles by light source which initiating reaction with reducing agent, oxidant or semiconductor nano-material.

BACKGROUND

For a long time, textiles with colorized patterns attract consumers widespread, owing to the abundant colors, detailed and vivid designs. Besides, it often receives favors by producers because of its high value-added and economic benefits. Usually, colorized patterns are obtained by the methods of direct and resist printing in the conventional processing. Direct printing is mainly suitable for producing colorized patterns on a white or light background, and resist printing can be used to obtain pastel colored patterns on the dark background.

Conventional printing method is considered as a process with long time processing and complicated procedures, following with numerous factors that affecting the quality of the products. That is to say conditions are difficult to control. Furthermore, on the one hand it makes large demands on chemicals, water and energies; on the other hand it produces lots of wastewater and contaminants, which account for a huge challenge to the protecting of ecology and environment, as well as the production costs.

Consequently, instead of the conventional process, providing an efficient, green, ecological and environmental protecting new method of printing process not only can obtain colorized patterns, but also decrease the consumption of energy, reduce the applications of common chemicals and facilitate the achievement of cleaner production. Hence, it has an important significance of realization of energy saving and emissions reduction in enterprises of textile dyeing and printing.

CONTENT OF THE INVENTION

In order to overcome the existing problems of the technology, present invention provides a photocatalytic method of colored discharge printing for producing colorized patterns on over-dyeing textiles in the condition of normal pressure and temperature with single apparatuses and process, having advantages of energy saving, emission reduction and cleaner production.

In order to achieve the goal of present invention, the process mainly comprises the following steps:

1. Dye the substrates with illuminant dyes to obtain dyed products;

2. Over dye the dyed products with ground shade dyes to obtain over-dyeing textiles;

3. Closely integrate the hollow-outs patterned printing plates and the over-dyeing textiles, or the printing plates are fixed in one side or both sides of the textiles; then the photocatalytic matter which is one of solution, collosol and white paste containing photocatalyst is applied on the hollow-outs of the patterns. The concentration of the photocatalytic matter is 0.10 g/L~10.00 g/L, and the pH value is 2~12; the photocatalytic matters described are reducing agents, oxidants and semiconductor nano-materials, or any combination of them, 4. Put them in a sealed container with a light source, and open the lamp following with light irradiating the over-dyeing textiles vertically and uniformly through the hollow-outs of patterned printing plates; then treat them by photochemical reaction in the condition of temperature ranging from 5° C. to 70° C., and processing time 1~120 minutes. Ultimately, textiles with single or double sided colorized patterns which having a different shade to the textiles over-dyed are obtained.

5. Wash the textiles at room temperature and dry them to obtain products with colorized patterns.

The illuminant dyes described in the invention are vat dyes with types of anthraquinone, indigoid and heterocycle, or the corresponding products that are temporary soluble; the specific illuminant dye is Vat Golden Yellow RK or Vat Brilliant Violet 2R. The ground shade dyes described are azo dyes or heterocyclic dyes that are sensitive to light; the specific ground shade dye is Direct Sky Blue 5B, Direct Bordeaux GB, Direct Fast Turquoise Blue GB or Direct Dark Green NB. The photocatalyst is potassium persulfate.

The methods of applying photocatalyst to hollow-outs of over-dyeing textiles include nozzle spraying, squeegee, mechanical or artificial coating.

The light source described is ultraviolet or visible light, whose power is 5~500 W.

The textiles are types of cellulose or its modified products.

The patterned printing plates with hollow-outs described are produced by mechanical or manual engraving, or laser etching with materials which are opaque and thin or the thick films.

Compared with present technology, the invention has the advantages as follows: due to the decomposition of photocatalyst promoted by photacatalytic technology, highly active substances are produced or released, and the ground shade dyes which are sensitive to light are destroyed and localized discolored, while the illuminant dyes are preserved and exhibited, resulting in the achievement of colorized patterns that are different from over dyeing. The invention has the characteristics of simple experimental conditions and process, wide adaptability of pH values, easy controlling and high productivity, as well as the elimination of the needs for printing pastes and complicated process of steaming and desizing in conventional printing method; additionally, photocatalytic solution can be reused, avoiding generous applications of chemical agents and waste discharges in the conventional printing method. It is beneficial to cutting costs, possessing the significant advantages of energy saving, emission reduction and cleaner production. Thus, the invention has a very glorious prospect of application in the cleaner production of textile dyeing and printing industries.

Figure 1:
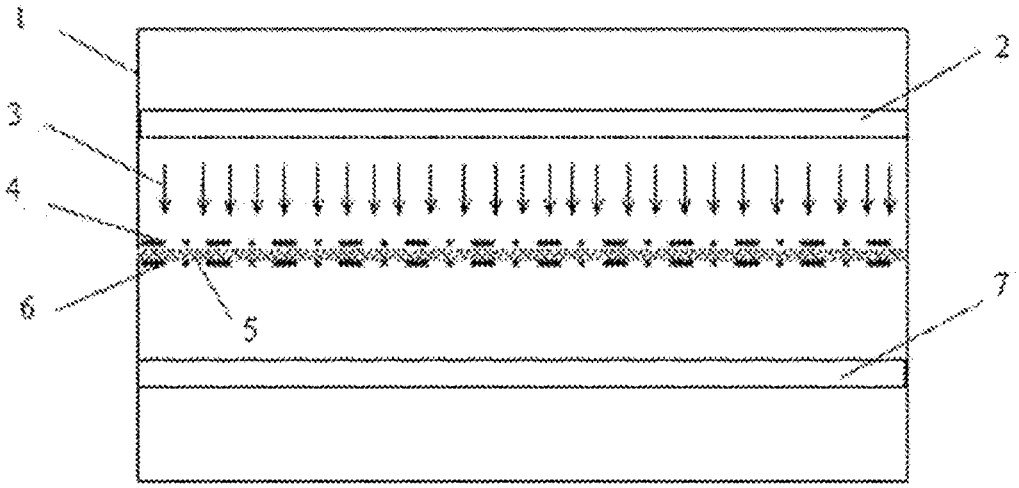
FIG. 1 of the drawings is the schematic of a reactor provided by present invention, and it is used for producing colorized patterns on over-dyeing textiles adopting the photocatalytic method of colored discharge printing.

In the FIG. 1: 1. Photocatalytic processing unit; 2 and 7. Light source; 3. Vertical light; 4 and 6. Printing plate with hollow-outs patterns; 5. Dyed textiles.

CONCRETE INSTANCE

Combined with the appended drawings and specific examples, make a further illustration for this invention.

The concrete chemicals involved are as follows:

Illuminant dyes: Vat Golden Yellow RK and Vat Brilliant Violet 2R are commonly commercial products;

Ground shade dyes: Direct Sky Blue 5B, Direct Bordeaux GB, Direct Fast Turquoise Blue GB and Direct Dark Green NB are commonly commercial products;

Photocatalyst: Potassium persulfate is also commonly commercial product.

EXAMPLE 1

A photocatalytic method of colored discharge printing for producing patterns on textiles provided by this example includes the following steps:

1. Textiles are dyed with selected illuminant dyes by conventional dyeing method. The substrate is cotton fabric (dimension of 8 cm×20 cm), and the processing conditions are as common as: the dosage of Vat Golden Yellow RK is 2.5% o.m.f, sodium chloride is 20.0 g/L, sodium hydroxide is 7.5 g/L, sodium hydrosulfite is 10.0 g/L, sulfonated castor oil is 0.2 g/L, and the liquor ratio is 1 to 50; the textile is dyed with Vat Golden Yellow RK by the method of dry-cylinder reduction, namely put the dye weighed in a beaker, slurried with a few drops of Swire oil, diluted with a little deionized water, then ⅔ of the amount of caustic soda and sodium hydrosulfite, ¼ of the amount of water are added; the formulation is stirred and heated to 50° C., reducing for 10~15 minutes, and the rest amount of water and caustic soda, sodium hydrosulfite are employed into the formulation, stifling and acquiring the dyeing bath of leuco at the temperature of 50° C. Put the bleached and mercerized cottons into the formulation, then the cottons are dyed for 15 minutes following with half of the amount of salts added, the rest is employed after continuous dyeing for 15 minutes; the dyeing process is completed after 15 minutes; the samples are removed from the formulation, and due to the oxidation of air, coloration are achieved. Finally, the colored fabrics are obtained after the treatment of washing in cold water, soaping (soap power is 2.0 g/L, sodium carbonate is 2.0 g/L, the temperature and treating time is 95° C. and 10 minutes respectively, liquor ratio is 1 to 30), washing and drying.

Textiles aforementioned are over dyed with the ground shade dyes, and the processing conditions are as follows: the dosage of Direct Sky Blue 5B is 1.0% o.m.f, sodium chloride is 20.0 g/L, Peregal O is 0.2 g/L, and the liquor ratio is 1 to 50; then make the desired ground dye together with Peregal O into the formulation, and put the bleached and mercerized cottons into the formulation at 40° C.; the dyeing bath is gradually heated up to 90° C. within 15 minutes, and it is held about 15 minutes following with half of the amount of salts added, the rest is employed after continuous dyeing for 15 minutes; the dyeing bath is gradually cooled to 50° C. after dyeing for 15 minutes. Finally, the samples are removed from the formulation, wash in cold water and dry to obtain the products.

Refer to FIG. 1, it is the schematic of a reactor provided by present example, and it is used for producing colorized patterns on over-dyeing textiles adopting the photocatalytic method of colored discharge printing. At the top (and/or bottom) of the processing unit 1, there is a lamp 2 (and/or lamp 7) in the suitable position, and 2 is a low-pressure mercury lamp whose power is 8 W.

The patterned printing plates with hollow-outs described are produced by mechanical or manual engraving, or laser etching with materials which are opaque and thin or the thick films.

Closely integrate the hollow-outs patterned printing plate 4 (and/or 6) and dyed textile 5, or the printing plate 7 is fixed in one side or both sides of textile 5; in this example, the printing plate 4 is fixed over the fabrics, and they are placed in the reactor as presented in FIG. 1, following with light irradiating the textiles through the hollow-outs of patterned printing plates. Then the solution of potassium persulfate whose concentration is 8.0 g/L and pH value is 3 is imposed on the hollow-outers of the fabrics by the method of spraying. Turn on the light source, the dyed cotton fabrics are treated as long as 75 minutes at the temperature of 40° C.

Wash the textiles photocatalytic-discharged at room temperature and dry them to obtain products with colorized patterns.

Make comparisons of apparent color depth (K/S value) and strength of cotton fabrics before and after the treatment of photocatalytic color discharge printing. The results are as follows.

Measurement of apparent color depth (K/S value) on patterns of textiles treated by the photocatalytic method of color discharge printing The apparent color depths of samples before and after the treatment are measured at three different positions by employing an Ultrascan PRO matching instrument (HunterLab. Co., Ltd., USA) with illuminant of D65 and angle of 10°, and the average is regarded as apparent color depth of the sample.

Figure 2:
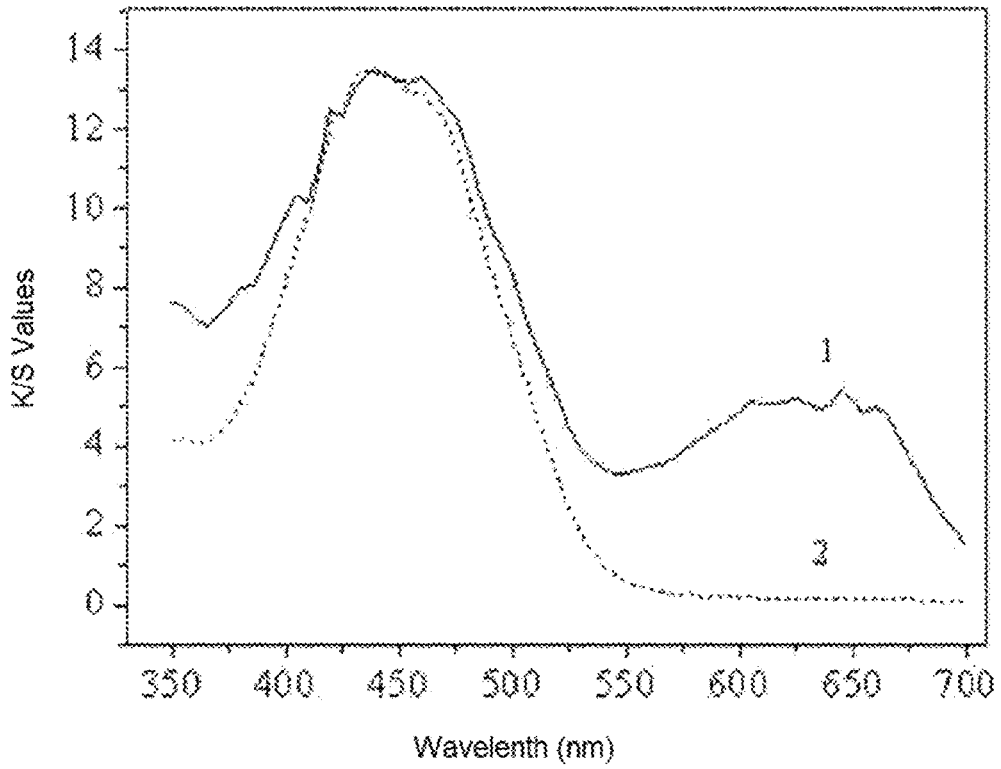
FIG. 2 presents the curves of K/S values before and after photocatalytic treatment with the cotton fabrics over dyed by direct/vat dyes as example 1 recited.

Refer to FIG. 2, it is the curves of K/S values before and after photocatalytic treatment with cotton fabrics over dyed by direct/vat dyes. In FIG. 2, curve 1 is before the treatment and curve 2 is after the treatment. As it can be seen from FIG. 2, before the treatment, the maximum absorption wavelength of Direct Sky Blue 5B is in the range of 600 nm~675 nm, while Vat Golden Yellow RK's is in the range of 425 nm~475 nm. After the treatment, as the function of UV light and photocatalyst, the adsorption peak of Direct Sky Blue 5B at 635 nm disappears, indicating a fact that the parent structure of ground dye has been completely destroyed. Meanwhile, FIG. 2 shows that, in the range of 425 nm~475 nm, there is still existing a high absorption peak, indicating that the illuminant dye is preserved well. There is no shift or change of the adsorption peak, stating it is making no difference of the parent structure of the dye, as well as its color, so that the patterns on fabric get a good performance. It is can be concluded that colorized patterns on over-dyeing textiles can be achieved effectively by the method as present invention recited.

Measurement of the Fabric Strength

According to the standard of GB/T 3923.1-1997, the breaking strength of fabrics is measured by Electronic Fabric Strength Apparatus YG026B with the method of strip. Table 1 is the results of retention rate of breaking strength with the cotton fabrics that are over dyed by direct/vat dyes. The retention rate of fabric strength is calculated as follows:

$$\text{Retention rate of strength} = \frac{\text{breaking strength of fabrics treated}}{\text{breaking strength of fabrics over dyed}} \times 100\%$$

Table 1 illustrates the change of warp-direction strength after the treatment of photocatalytic colored discharge printing with cotton fabrics over dyed by direct/vat dyes.

TABLE 1

| Photocatalyst | Retention rate of fabric strength (warp-direction, %) |
|---|---|
| Over-dyeing cotton fabric | — |
| Potassium persulfate ($K_2S_2O_8$) | 85.4 |

Table 1 reveals a fact that, after the treatment in present invention, the warp-direction strength of the colorized patterned fabrics has been reduced to a certain degree. This is due to the oxidizability of ultraviolet light and photocatalyst, which resulting in the loss of fabric strength. Thus, power of light, dosage of photocatalyst and the processing time should be controlled properly, which can mitigate the damage to fabrics and reduce the influence of processing factors impacting on strength.

EXAMPLE 2

Some steps are the same of example 1 with the photocatalytic method of colored discharge printing for producing colorized patterns on textiles. In step 2, the ground shade dye is Direct Bordeaux GB whose dosage is 0.5% o.m.f, and in step 3, the over-dyeing cotton fabric is treated as long as 35 minutes at the temperature of 60° C.

EXAMPLE 3

Steps of the photocatalytic method of colored discharge printing for producing colorized patterns on textiles can refer to example 1. In step 1, the illuminant dye is Vat Golden Yellow RK whose dosage is 0.5% o.m.f; in step 2, the ground shade dye is Direct Fast Turquoise Blue GB whose dosage is 0.5% o.m.f; in step 3, the over-dyeing cotton fabric is treated as long as 60 minutes at the temperature of 30° C.

EXAMPLE 4

Steps of the photocatalytic method of colored discharge printing for producing colorized patterns on textiles can refer to example 1. In step 1, the illuminant dye is Vat Brilliant Violet 2R whose dosage is 0.5% o.m.f; in step 2, the ground shade dye is Direct Dark Green NB whose dosage is 0.5% o.m.f; in step 3, the pattern is the trademark of Apple, and the over-dyeing cotton fabric is treated as long as 20 minutes at the temperature of 10° C. The result can be seen in FIG. 3.

Figure 3:
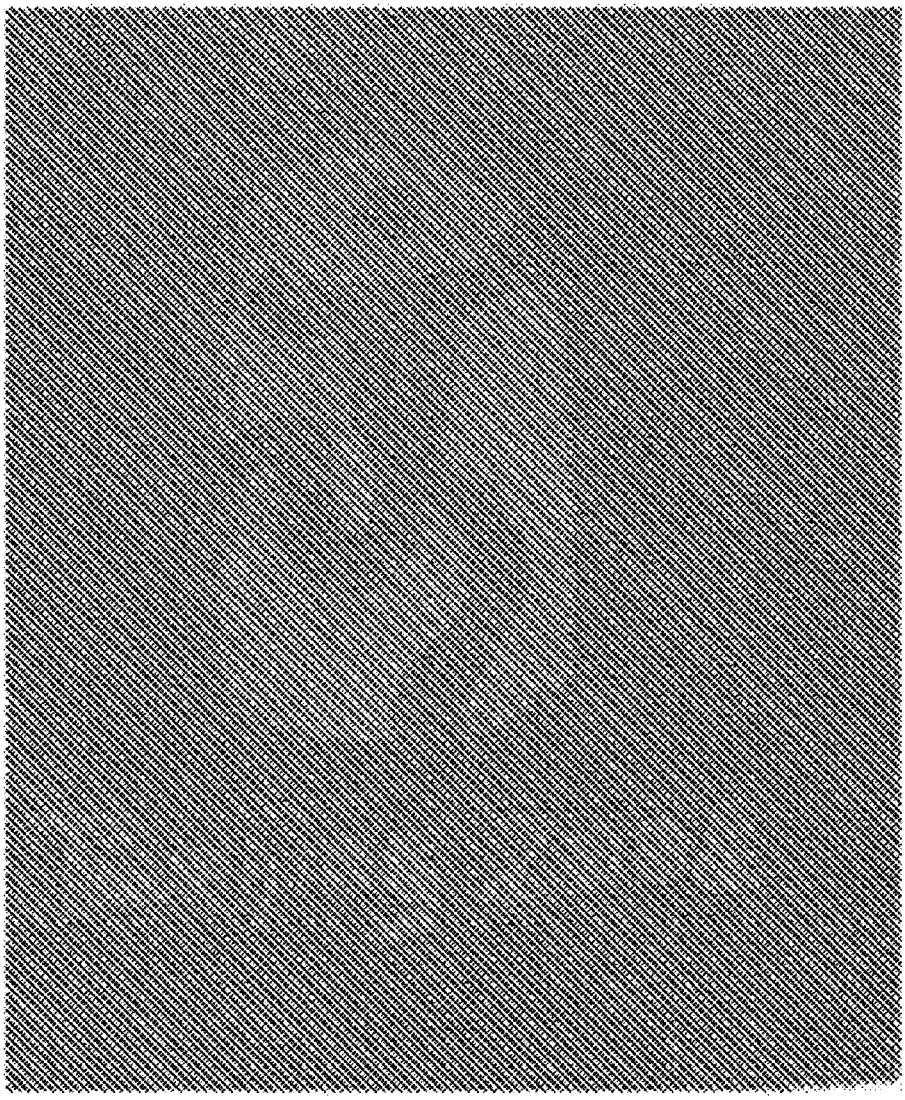
FIGS. 3-5 are impression drawings of the Beijing Olympics logo as example 2 recites (patterns of golden, background of red brown), the Guangzhou Asian Games logo as Example 3 recites (patterns of yellow, background of green), and the trademark of Apple as example 4 recited (patterns of purple, background of navy blue), respectively.
Figure 4:
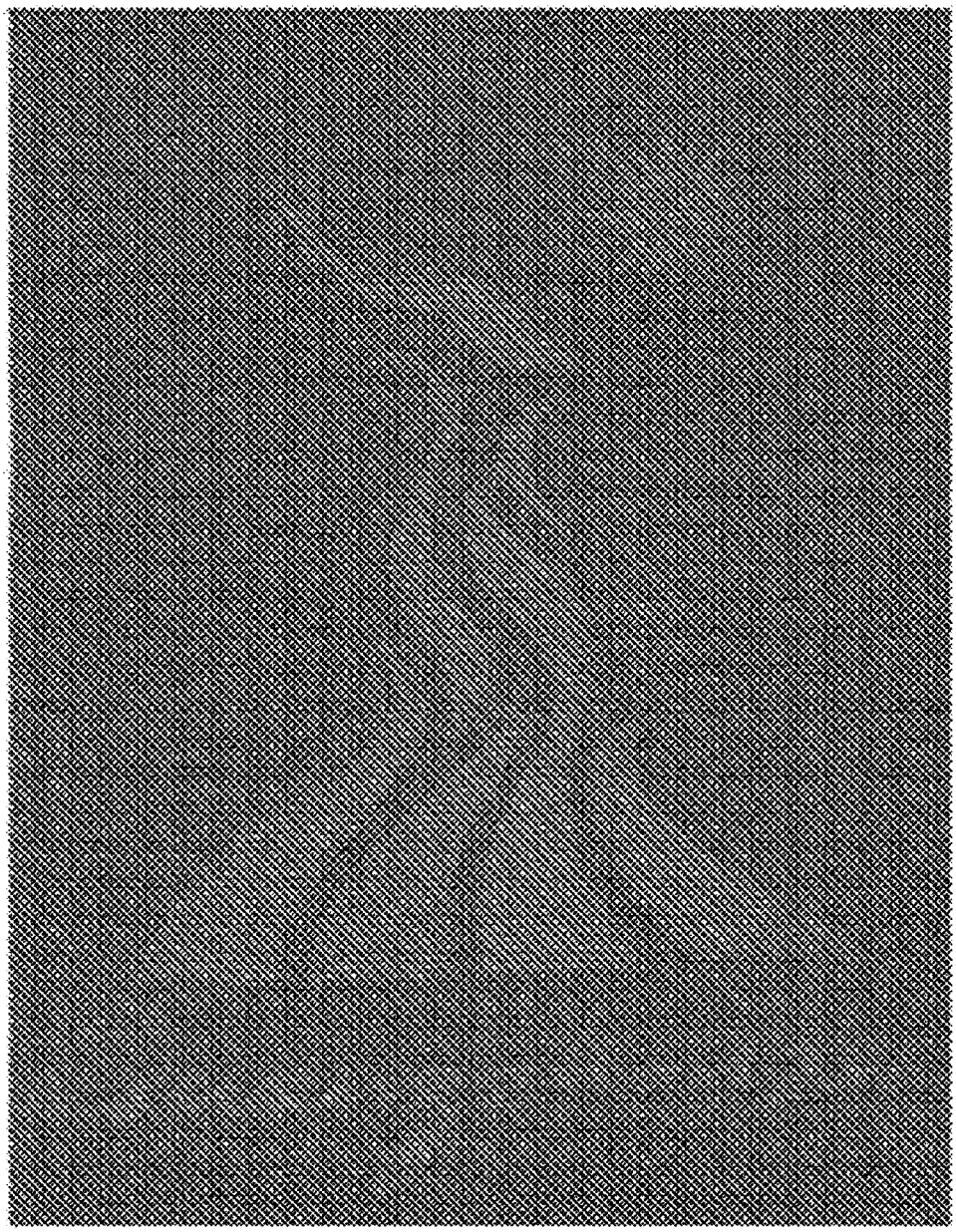
Figure 5:
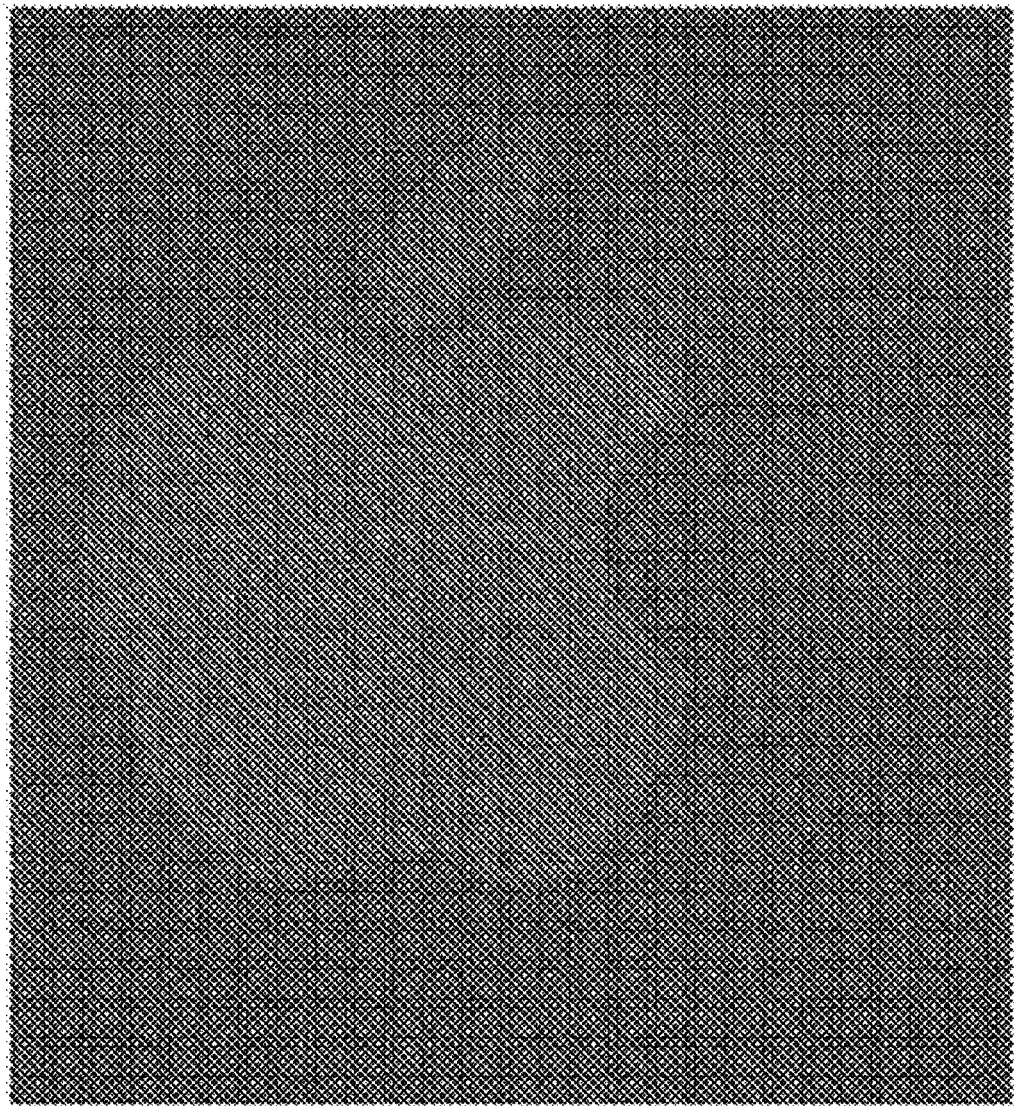

As can be seen from FIG. 3, using the method provided by present invention can make the ground shade dyes completely destroyed and decolored, while allowing a fine preservaton of illuminant dyes. Finally ideal colorized patterns on fabrics are obtained, accompanying with clear designs, high sharpness, relaxed cloth and pure shade, which are just as the same effect of conventional printing. Meanwhile, the retention rate of warp-direction strength maintains a preferably range of 75%~85% among different structures of ground shade dyes, color depths and conditions of photochemical reaction.

The invention employing the technology of photochemical reaction, can be implemented on various types of textiles that are ground dyed, getting kinds of decorative patterns. Meanwhile, the invention eliminates the needs for printing pastes and expensive printing apparatuses as well as some conventional printing process such as steaming and desizing. It has the characteristics of simple equipment and process, short processing, effluent free and cleaner production. Thus, it has a very brilliant prospect of application.

What is claimed is:

1. A photocatalytic method of discharge printing for producing colorful patterns on previously dyed textiles consisting of the following steps:

a) dye textiles with illuminant dyes to obtain dyed textiles;

b) over dye the dyed textiles with ground shade dyes to obtain over-dyeing textiles;

c) closely integrate hollow-outs patterned printing plates and the over-dyeing textiles, or fix the printing plates on one side or both sides of the textiles; then apply a photocatalytic matter on the hollow-outs of the patterns wherein the photocatalytic matter is selected from one of the group consisting of a solution, a colloid and a white paste containing a photocatalyst, wherein the concentration of the photocatalytic matter is 0.10 g/L~10.00 g/L, the pH value is 2~12; and the photocatalyst is potassium persulfate, d) put the patterned printing plates and the over-dyeing textiles in a sealed container with a light source, and open the light source followed by light irradiating the over-dyeing textiles vertically and uniformly through the hollow-outs of the patterned printing plates; then treat the textiles by photochemical reaction at temperatures ranging from 5° C. to 70° C., and for processing times of 1~120 minutes, wherein textiles with single or double sided colorized patterns which have a different shade to the over-dyeing textiles are obtained, e) wash the textiles with single or double sided colorized patterns at room temperature and dry them to obtain textiles with colorized patterns.

2. A photocatalytic method of discharge printing for producing colorful patterns on previously dyed textiles as recited in claim 1, wherein the illuminant dyes are vat dyes selected from the group consisting of anthraquinone, indigoid and heterocycle dyes or their corresponding products which are temporarily soluble.

3. A photocatalytic method of discharge printing for producing colorful patterns on previously dyed textiles as recited in claim 1, wherein the illuminant dye is

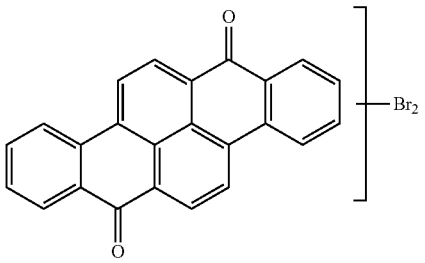

or

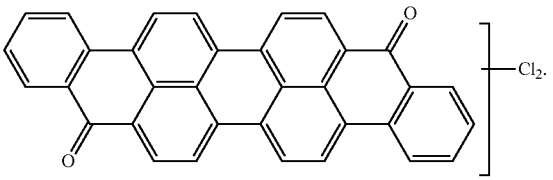

4. A photocatalytic method of discharge printing for producing colorful patterns on previously dyed textiles as recited in claim 1, wherein the ground shade dyes are azo dyes or heterocyclic dyes that are sensitive to light.

5. A photocatalytic method of discharge printing for producing colorful patterns on previously dyed textiles as recited in claim 1, wherein the ground shade dye is

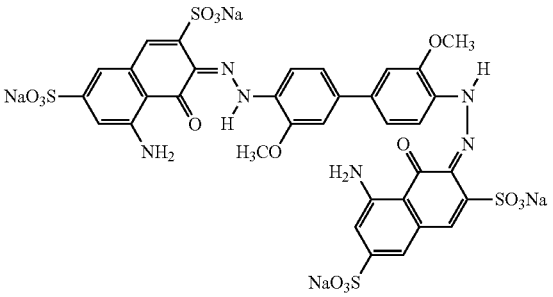

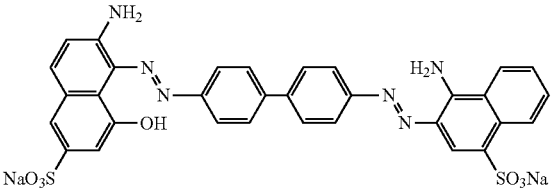

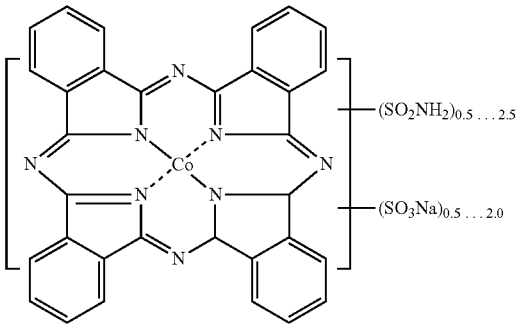

or

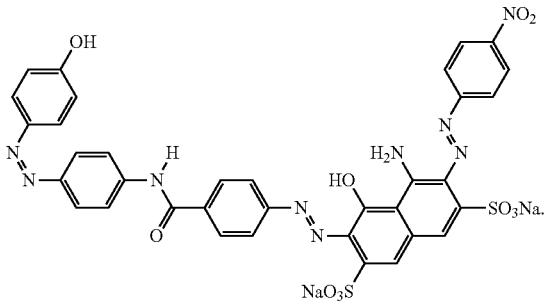

6. A photocatalytic method of discharge printing for producing colorful patterns on previously dyed textiles as recited in claim 1, wherein the methods of applying photocatalyst to hollow-outs of over-dyeing textiles are selected from nozzle spraying, squeegee, mechanical or artificial coating.

7. A photocatalytic method of discharge printing for producing colorful patterns on previously dyed textiles as recited in claim 1, wherein the light source described is ultraviolet or visible light, whose power is 5~500 W.

8. A photocatalytic method of discharge printing for producing colorful patterns on previously dyed textiles as recited in claim 1, wherein the textiles are types of cellulose or its modified products.

9. A photocatalytic method of discharge printing for producing colorful patterns on previously dyed textiles as recited in claim 1, wherein the patterned printing plates with hollow-outs are produced by mechanical or manual engraving, or laser etching with materials which are opaque and thin or the thick films.

* * * * *